United States Patent [19]

Dyer et al.

[11] 4,021,501

[45] May 3, 1977

[54] PRODUCTION OF HYDROCARBONS

[75] Inventors: Peter Dyer; David Charles Alexander Waterman, both of Billingham, England

[73] Assignee: Imperial Chemical Industries Limited, London, England

[22] Filed: Aug. 12, 1975

[21] Appl. No.: 605,447

[30] Foreign Application Priority Data

Aug. 28, 1974 United Kingdom ..... 37572/74

[52] U.S. Cl. ..... 260/683 R; 208/48 Q; 208/130

[51] Int. Cl.[2] ..... C07C 3/30

[58] Field of Search ..... 260/683 R; 208/48 Q, 208/130

[56] References Cited

UNITED STATES PATENTS

| | | | |
|---|---|---|---|
| 2,852,440 | 9/1958 | Smith et al. | 260/683 |
| 3,103,485 | 9/1963 | Cahn | 260/683 |
| 3,487,121 | 12/1969 | Hallee | 260/683 |
| 3,579,438 | 5/1971 | Cruse | 208/130 |
| 3,842,138 | 10/1974 | Chahvekilian et al. | 260/683 |

*Primary Examiner*—C. Davis
*Attorney, Agent, or Firm*—Cushman, Darby & Cushman

[57] ABSTRACT

In the thermal cracking of a hydrocarbon feedstock, the quenching of the gases leaving the cracking zone is deliberately deferred for a very short time to permit continued endothermic reaction and thereby increase the ethylene yield.

11 Claims, No Drawings

PRODUCTION OF HYDROCARBONS

This invention concerns processes for the pyrolysis, or "cracking", of hydrocarbon feedstocks and more especially the invention concerns cracking processes, normally using a process stream diluent, for example steam or hydrogen, in which a hydrocarbon mixture containing a substantial proportion of saturated hydrocarbons is pyrolysed in the course of passage through radiantly heated tubes to lower molecular weight hydrocarbons including, as principal products, ethylene, propylene, aromatic hydrocarbons and butadiene. The hydrocarbon feedstock may, for example, comprise cyclic and non-cyclic aliphatic hydrocarbons of carbon contents in the range $C_4$ to $C_{10}$. A feedstock commonly used is naphtha which is a cut derived by petroleum fractionation and which contains such $C_4$ to $C_{10}$ aliphatic hydrocarbons together with some aromatic hydrocarbons.

In recent years efforts have been directed towards increasing ethylene yields when cracking, especially, mixed higher hydrocarbon feedstock, such as naphtha, and, as part of the development to that end, higher severity cracking furnaces have been developed and proposed. In these furnaces, the rates of heat supply to the pyrolysis tubes are relatively higher, the residence times of the process streams in the so-called radiant zones of the furnaces are relatively lower and, therefore, the abrupt quenching of the process streams occurs relatively sooner.

Quenching of process streams is necessary because the effluent cracked gas temperatures are very high, and at these high temperatures the cracking reactions are still proceeding at a rapid rate. In order to substantially stop the reactions in the effluent gas and to minimise the production of undesirable by-products, it has been the practice to rapidly cool the effluent gas immediately after it leaves the furnace reactor to a temperature at which the reactions are substantially stopped.

We have now found that immediate quenching of the emergent effluent gas is not necessary and that advantages are to be gained by avoiding abrupt quenching.

Accordingly, the present invention provides a process of thermally cracking a hydrocarbon feedstock wherein, prior to abrupt quenching of the process stream, the process stream emerging from the radiant zone of a pyrolysis furnace at a temperature above 700° C, and preferably above 750° C, is allowed to undergo endothermic reaction beyond the radiant zone for a period of at least 0.03 seconds such that its temperature falls as a result of heat uptake by continued endothermic reactions from a value above 700° C, and preferably above 750° C, whereby to enhance ethylene yield.

We have found that there is no determinable temperature greater than 700° C above which the process of the invention is inoperable. Such a maximum temperature is more likely to be determined by mechanical considerations, such as the capability of the materials of construction to withstand high temperatures, than by process operating constraints. In practice, the maximum temperature of an emergent gas likely to occur in a modern cracking plant is of the order of 870° C.

It is preferred that the period during which the emergent process stream is allowed to undergo endothermic reaction should be in the range 0.03 to 1 second, more preferably in the range 0.04 to 0.08 seconds.

The equipment and apparatus, for example a separate vessel or a conduit, in which the process of the invention is carried out, need have no special properties or characteristics other than those usually associated with equipment used in this art and suitable equipment and apparatus will be readily perceivable by those familiar with the art. Preferably, the equipment and apparatus is thermally lagged. Conveniently, the process of the invention is carried out immediately beyond the radiant zone of the pyrolysis furnace.

In modified forms of the process of this invention, a diluent, for example steam or hydrogen, and/or an additional hydrocarbon stream, for example a stream containing butenes, is added to the process stream. The addition of a diluent enables greater control, where necessary, of the process of the invention and one of the effects which may occur is a drop in temperature of the process stream.

In addition of a hydrocarbon stream may also result in a drop in temperature of the process stream but principally it allows a higher output of desirable products to be obtained by cracking of the added hydrocarbons.

The point(s) at which the diluent and/or additional hydrocarbon stream is added is to some extent a matter of operating convenience. The addition may be made at a point following the emergence of the process stream from the radiant zone of the pyrolysis furnace but prior to the commencement of the process of the invention. Alternatively, it may be made in the initial stages of the process of the invention, for example nearer the upstream inlet end than the downstream outlet end of the apparatus, for example a thermally lagged conduit, in which the process of the invention is being carried out.

The process of the invention leads to an increase in the ethylene yield and usually also in the yield of total aromatics as against ethylene and total aromatics yields obtained similarly but with substantially immediate quenching beyond the outlet from the radiant zone of the furnace. In a typical instance the temperature of the process stream might drop as a direct result of these subsequent endothermic reactions from 850° to 817° C within 0.06 seconds and the ethylene yield might be enhanced by as much as 4 weight % on feedstock. Accompanying the increased yield of ethylene, there is also some increase in carbon formation in the quenching operation. However, we have found that the increased carbon formation does not present a great problem and that existing quenching technology can readily deal with it. This process of the invention is not peculiar to any particular manner of furnace firing or configuration of furnace tubes or to especially short residence time operations or to any particular cracking feedstock. The process of the invention is especially useful in the situation where furnace life is limited by radiant coking. It is a useful adjunct to the process of our U.K. Pat. No. 49163/73, but we have found similar benefits can be obtained in a conventionally fired furnace in which the residence time of the process stream within the tube coils in the radiant zone of the furnace is, for example, 0.6 seconds. The feedstocks which may be used in the process of this invention include, for example, naphtha, gas oil, gaseous hydrocarbon feedstocks, ethane, propane, butane.

One embodiment of the process of this invention will now be described by way of Example and in comparison with a cracking operation not employing the process of this invention.

EXAMPLE

A mixture of a straight-run naphtha and steam in a weight ratio of 0.5 parts steam to 1 part naphtha was preheated to a temperature of 600° C and delivered as feed to the tubes of a conventional cracking furnace at a pressure of 22 p.s.i.g. The residence time within the radiant section of the cracking zone was 0.6 seconds. The process stream emerged from the radiant zone at a pressure of 15 p.s.i.g. and at a temperature of 833° C. The composition of the emergent cracked gases, after abrupt quenching in known manner, was as shown in column 2 of the Table.

The experiment was repeated except that deferred quenching was employed according to the process of this invention so as to allow the cracked gases to undergo continued endothermic reaction in a thermally lagged conduit for a period of 0.06 seconds. The temperature of the gases during this endothermic reaction fell from 833° to 815° C and the gases were then quenched. The composition of the cracked gases subjected to deferred quenching was as shown in column 3 of the Table. As can be seen, there was a 4% increase in the ethylene yield.

TABLE

| | 2 | 3 |
|---|---|---|
| | Product Yield (wt. %) | |
| Product | Abrupt quenching | Deferred quenching |
| Methane $CH_4$ | 11.5 | 13.7 |
| Ethane $C_2H_6$ | 5.2 | 5.2 |
| Ethylene $C_2H_4$ | 25.7 | 29.7 |
| Propylene $C_3H_6$ | 13.4 | 12.3 |
| Butadiene $C_4H_6$ | 3.1 | 3.5 |
| $C_5$+ | 33.2 | 29.2 |

We claim:

1. A process of thermally cracking a hydrocarbon feedstock wherein, prior to abrupt quenching of the process stream, the process stream emerging from the radiant zone of a pyrolysis furnace at a temperature above 700° C is allowed to undergo endothermic reaction beyond the radiant zone for a period of at least 0.03 seconds such that its temperature falls as a result of heat uptake by continued endothermic reactions from a value above 700° C whereby to enhance ethylene yield.

2. A process as claimed in claim 1 in which the emergent process stream is allowed to undergo endothermic reaction for a period in the range 0.03 to 1 second.

3. A process as claimed in claim 1 in which the process stream emerges from the radiant zone of the pyrolysis furnace at a temperature above 750° C.

4. A process as claimed in claim 1 in which the process is carried out in a thermally lagged conduit.

5. A process as claimed in claim 1 in which the process is carried out immediately beyond the radiant zone of the pyrolysis furnace.

6. A process as claimed in claim 1 in which a diluent is added to the process stream.

7. A process as claimed in claim 6 in which the diluent is steam or hydrogen.

8. A process as claimed in claim 1 in which an additional hydrocarbon stream is added to the process stream.

9. A process as claimed in claim 1 in which the process stream emerging from the radiant zone of the pyrolysis furnace is derived from a thermal cracking process employing a process stream diluent, preferably steam or hydrogen.

10. In a process of thermally cracking a hydrocarbon feedstock, comprising (a) a thermal cracking step and (b) an abrupt quenching of the process stream of said cracking step, the improvement consisting essentially of an additional step (c) which comprises directing the process stream to an endothermic reaction zone, which process stream remains in the endothermic reaction zone for a period of time ranging from 0.03 to 1 second, in which zone endothermic reactions occur with concomitant heat uptake and decrease in temperature, said additional step being undertaken prior to said quenching, said additional step resulting in enhanced ethylene yields.

11. The process of claim 10, wherein said process stream is admixed with a diluent.

* * * * *